US010794664B1

(12) United States Patent
Moreno

(10) Patent No.: US 10,794,664 B1
(45) Date of Patent: Oct. 6, 2020

(54) FIREARM SUPPORTING RATCHET BELT WITH ENHANCED STRENGTH AND ADJUSTABILITY

(71) Applicant: Michael Abraham Moreno, Tecumseh, OK (US)

(72) Inventor: Michael Abraham Moreno, Tecumseh, OK (US)

( * ) Notice: Subject to any disclaimer, the term of this patent is extended or adjusted under 35 U.S.C. 154(b) by 0 days.

(21) Appl. No.: 16/360,444

(22) Filed: Mar. 21, 2019

Related U.S. Application Data

(60) Provisional application No. 62/646,094, filed on Mar. 21, 2018.

(51) Int. Cl.

| | |
|---|---|
| ***F41C 33/04*** | (2006.01) |
| ***A41F 9/00*** | (2006.01) |
| ***A45F 5/02*** | (2006.01) |
| ***A41F 9/02*** | (2006.01) |

(52) U.S. Cl.
CPC ..... *F41C 33/046* (2013.01); *A41F 9/002* (2013.01); *A41F 9/025* (2013.01); *A45F 5/021* (2013.01); *A45F 2200/0591* (2013.01)

(58) Field of Classification Search
CPC ..... A41F 9/02; A44B 11/065; A44B 11/12; A44B 11/125; A44B 11/2592; F41C 33/046; Y10T 24/4016
See application file for complete search history.

(56) References Cited

U.S. PATENT DOCUMENTS

| | | | | | |
|---|---|---|---|---|---|
| 4,747,527 | A * | 5/1988 | Trumpower, II | A41F 9/002 | 2/311 |
| 5,464,136 | A * | 11/1995 | Eddy | A45F 5/021 | 224/666 |
| 5,572,747 | A * | 11/1996 | Cheng | A44B 11/12 | 2/312 |
| 5,579,563 | A * | 12/1996 | Sim | A41F 9/002 | 24/170 |
| 5,586,969 | A * | 12/1996 | Yewer, Jr. | A61F 5/028 | 128/101.1 |
| 5,683,022 | A * | 11/1997 | Evans | A41F 9/002 | 224/583 |
| 5,722,576 | A * | 3/1998 | Rogers | A45F 5/02 | 224/195 |
| 5,819,320 | A * | 10/1998 | Jolla | A41F 9/00 | 2/236 |

(Continued)

*Primary Examiner* — Brian D Nash
(74) *Attorney, Agent, or Firm* — Plager Schack LLP; Mark H. Plager; Eric Liou

(57) ABSTRACT

A ratchet belt worn by a user to support a plurality of firearms, tactical gear and equipment thereon is provided. The ratchet belt includes a flexible strip designed to support any number of the plurality of firearms, tactical gear and equipment thereon, a ladder strap coupled to the flexible strip and having a plurality of teeth, and a ratchet assembly coupled to the flexible strip and having a crank arm rotatably mounted to a buckle where the crank arm is designed to engage with one of the plurality of teeth on the ladder strap. The flexible strip is disposed around the user to permit the first end of the ladder strap to insert through the buckle of the ratchet assembly. The crank arm is rotatably adjusted to engage with one of the plurality of teeth in the ladder strap to enable the flexible strip to conform to the user.

8 Claims, 4 Drawing Sheets

(56) References Cited

U.S. PATENT DOCUMENTS

| | | | | |
|---|---|---|---|---|
| 7,762,440 | B2 * | 7/2010 | Cook | F41C 33/046 2/338 |
| 9,149,090 | B1 * | 10/2015 | Taylor | A41F 9/02 |
| 2015/0359542 | A1 | 12/2015 | Steinbaugh | |
| 2016/0135547 | A1 | 5/2016 | Kuffrey | |
| 2016/0338451 | A1 | 11/2016 | Scoffier | |

* cited by examiner

FIREARM SUPPORTING RATCHET BELT WITH ENHANCED STRENGTH AND ADJUSTABILITY

RELATED APPLICATION

The application claims priority to provisional patent application U.S. Ser. No. 62/646,094 filed on Mar. 21, 2018, the entire contents of which is herein incorporated by reference.

BACKGROUND

The embodiments herein relate generally to belts worn by individuals. More specifically, embodiments of the invention are related to an adjustable belt designed to support firearms, tactical gear and equipment.

The military, law enforcement and civilians need a belt designed for use in securing firearms to the user's waist. During the course of a day, body weight, clothing, gear and other items are added, removed or discarded, which varies a person's width or contour, especially in law enforcement and military applications. Everyday carry (EDC) and/or carrying concealed weapon (CCW) advocates are also affected by these factors. In addition, the individual's body position such as when sitting in a vehicle, kneeling in bent positions, and moving constantly also affects the body width and girth.

Standard belts on the market do not currently allow for incremental adjustments for different types of body movements and various body fluctuations. Several other belts with ratcheting buckles exist as disclosed in U.S. Patent Application Publications 2016/0135547, 2016/0338451 and 2015/0359542. However, these belts are not designed to comply with the stringent requirements of law enforcement and military personnel with respect to load-bearing capacity and/or the ability to comfortably support weighted items on the belt when the user is in different body positions including the standing, seated, kneeling and bent positions. Further, these belts are limited for one or more of the following reasons: (1) the belt lacks the rigidity and/or strength to support firearms, tactical gear or equipment; (2) the buckles and/or slides on the belt are prone to failure and can be difficult to use; and/or (3) the belt requires the user to suck in his/her gut to properly tighten the belt.

As such, there is a need in the industry for a firearm ratchet supporting belt that addresses the limitations of the prior art. More specifically, there is a need for the firearm ratchet supporting belt to have enhanced strength and adjustability to ensure a proper fit around the user's waist. There is a further need for the firearm ratchet supporting belt to secure firearms and tactical gear/equipment without stretching, folding or sagging.

SUMMARY

In certain embodiments, a ratchet belt worn by a user with enhanced strength and load-bearing capacity is provided. The ratchet belt is configured to support a plurality of firearms, tactical gear and equipment thereon and permit the user to move into one of a plurality of body positions. The ratchet belt comprises a flexible strip comprising a first end and a second end, the flexible strip configured to support any number of the plurality of firearms, tactical gear and equipment thereon, a ladder strap coupled to the flexible strip and comprising a plurality of teeth, the ladder strap comprising a first end aligned with the first end of the flexible strip and a second end coupled to an intermediate portion of the flexible strip, and a ratchet assembly coupled to the second end of the flexible strip and comprising a crank arm rotatably mounted to a buckle, the crank arm configured to engage with one of the plurality of teeth on the ladder strap, wherein the flexible strip is configured to be disposed around the user to permit the first end of the ladder strap to insert through the buckle of the ratchet assembly, wherein the crank arm is rotatably adjusted to engage with one of the plurality of teeth in the ladder strap to enable the flexible strip to conform to the user.

In an alternative embodiment, a method for securing any number of firearms, tactical gear and equipment to a user is provided. The method comprises providing the ratchet belt, disposing the flexible strip of the ratchet belt around the user, inserting the first end of the ladder strap through the buckle of the ratchet assembly of the ratchet belt, maneuvering the crank arm of the ratchet assembly to engage with one of the plurality of teeth in the ladder strap, and attaching any number of the firearms, tactical gear and equipment to the flexible strip.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

In certain embodiments of the invention as depicted in FIGS. 1-5, ratchet belt 10 is worn by user 30 and configured to support any number of firearms 24 and accessories 26 thereon. Accessories 26 may include any tactical gear or equipment including, but not limited to, firearm magazines, ammunition, grenades, medical kits, tourniquets, knives, flashlights, pouches, and the like. As shall be apparent, ratchet belt 10 is designed for use in law enforcement, military and civilian markets.

Ratchet belt 10 is advantageous because it comprises an enhanced load-bearing capacity to support any number of firearms 24 and accessories 26 thereon while providing user 30 the ability to comfortably maneuver into different body positions including the standing, seated, kneeling and bent positions.

Figures 1, 2:
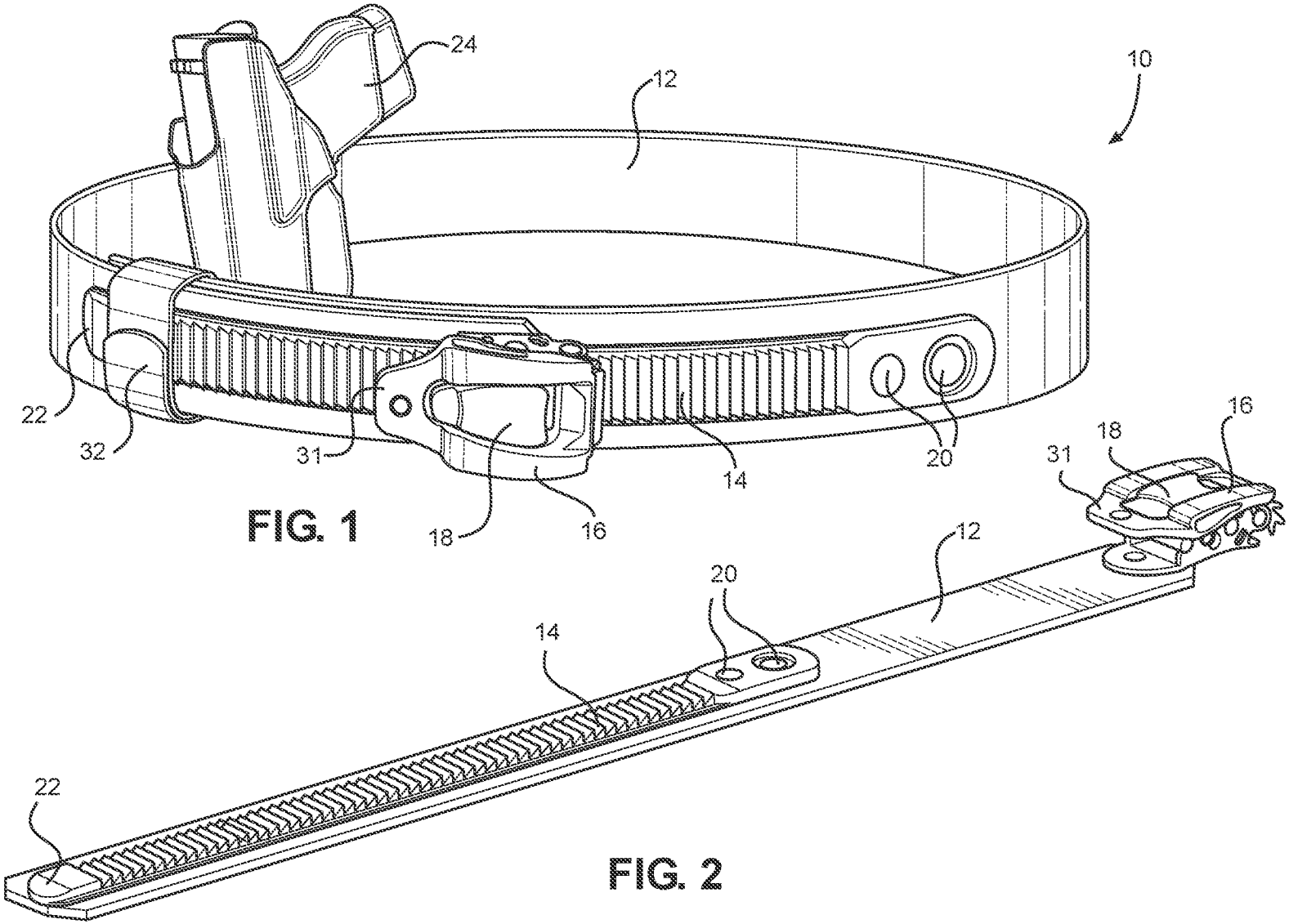
FIG. 1 depicts a perspective view of certain embodiments of the ratchet belt.
FIG. 2 depicts a perspective view of certain embodiments of the ratchet belt in a flat configuration.
Figure 3:
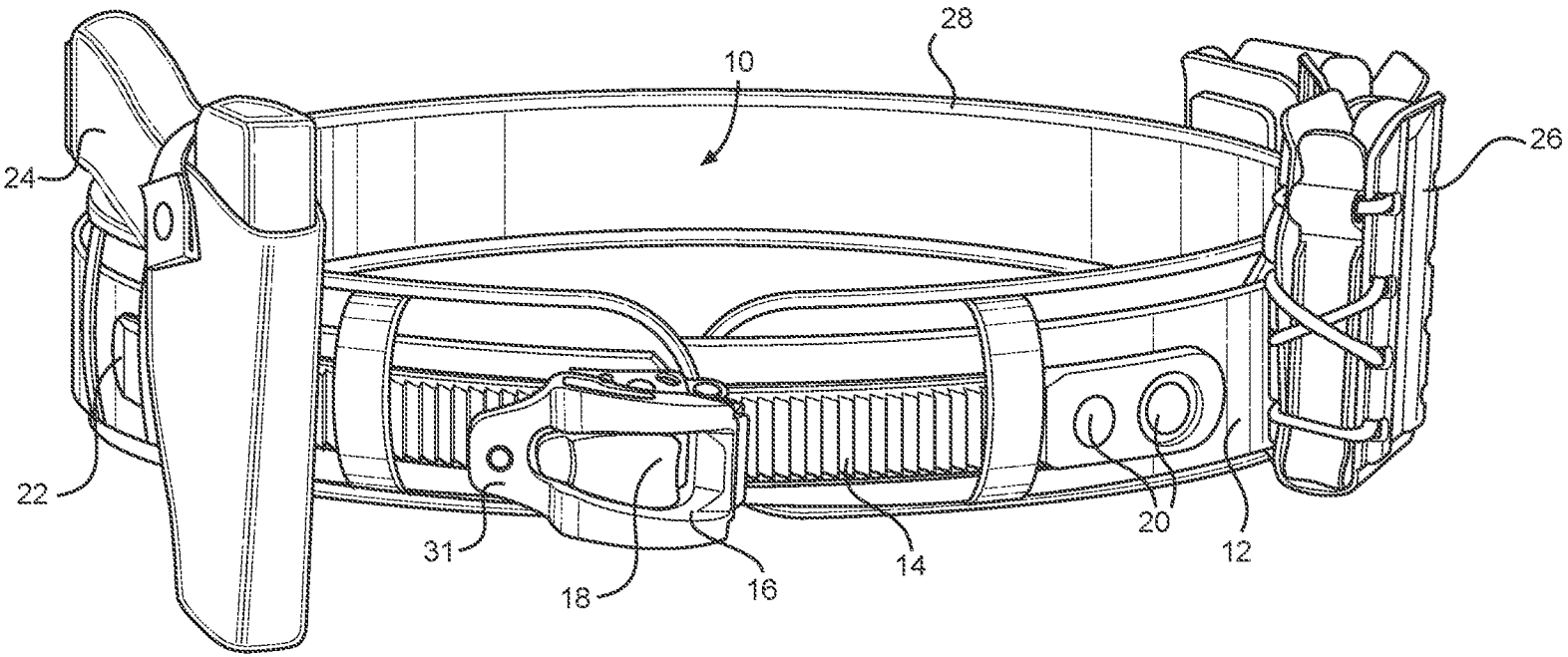
FIG. 3 depicts a perspective view of certain embodiments of the ratchet belt illustrating a firearm and accessory coupled to the belt.

In certain embodiments as depicted in FIGS. 1-3, ratchet belt 10 generally comprises main strip 12, ladder strap 14, and a ratchet assembly comprising buckle 16, release lever 18 and crank arm 31. In one embodiment, main strip 12 is preferably a flexible polymer coated nylon (BioThane) strip with a first end and a second end. Main strip 12 is preferably rated at 4500 pounds of tensile strength in various dimensions. This material provides the strength and support needed to secure firearms 24 and accessories 26 and prevents the strip from sagging, folding or stretching. However, it shall be noted that main strip 12 can have variable specifications. In an alternative embodiment, it shall be appreciated that main strip 12 may be useful when made from other materials known in the field including, but not limited to, webbing, leather, plastic, and the like.

In one embodiment, main strip 12 comprises approximate dimensions of a 1½"-2" width, 28"-62" length and 5/32" thickness. However, the dimensions of main strip 12 may vary to accommodate different applications and users of all ages and sizes. In one embodiment, the first end of main strip 12 comprises a front edge extending in a first plane that is continuously connected to a pair of side corner edges. Each side corner edge extends in a second plane that is oriented generally 45 degrees relative to the first plane. This shape of the first end of main strip 12 allows user 30 to easily don main strip 12.

In one embodiment, ladder strap 14 is a flexible strap with a first end, a second end and a plurality of teeth disposed throughout the strap. Ladder strap 14 is preferably made from a plastic or polymer rated at 500 pounds of tensile strength. However, ladder strap 14 can have variable specifications. The first end of ladder strap 14 comprises tapered end 22, which is aligned with the first end of main strip 12. The second end of ladder strap 14 is coupled to an intermediate portion of main strip 12 by mechanical fasteners 20 such as Chicago Screws, alternate posts, rivets or other fasteners. Although the figures depict two fasteners 20, it shall be appreciated that any alternate number of fasteners 20 can be used to secure ladder strap 14 to main strip 12.

Ladder strap 14 preferably has a length that is no longer than 11" to allow ratchet belt 10 to be easily maneuvered during use. In one embodiment, the pair of mechanical fasteners 20 extends through ladder strap 14 and main strip 12 at locations that are approximately 241 millimeters and 263 millimeters from the first end of main strip 12. However, mechanical fasteners 20 can extend through alternate locations on main strip 12.

In certain embodiments, the ratchet assembly is coupled to the second end of main strip 12 and comprises buckle 16, release lever 18 and crank arm 31. In one embodiment as depicted in FIG. 2, the ratchet assembly partially extends beyond the second end of main strip 12. This places buckle 16 in an easily accessible position that allows the user to insert ladder strap 14 therein.

Buckle 16 includes a frame preferably made from stainless steel that is coupled to main strip 12 by a screw, rivet or alternate mechanical fastener. In one embodiment, the frame of buckle 16 comprises an anti-rotation tab in contact with a face of the second end of main strip 12 to prevent rotational movement of buckle 16 relative to main strip 12.

Crank arm 31 is rotatably mounted to buckle 16 and is configured to engage with one of the plurality of teeth on ladder strap 14. In one embodiment, crank arm 31 is made from aluminum. However, crank arm 31 can be made from alternative materials known in the field. Release lever 18 is rotatably mounted to buckle 16 and is configured to communicate with any one of the plurality of teeth on ladder strap 14 as will be described in more detail later. In one embodiment, release lever 18 is made from plastic. However, release lever 18 can be made from alternative materials known in the field.

Figure 5:
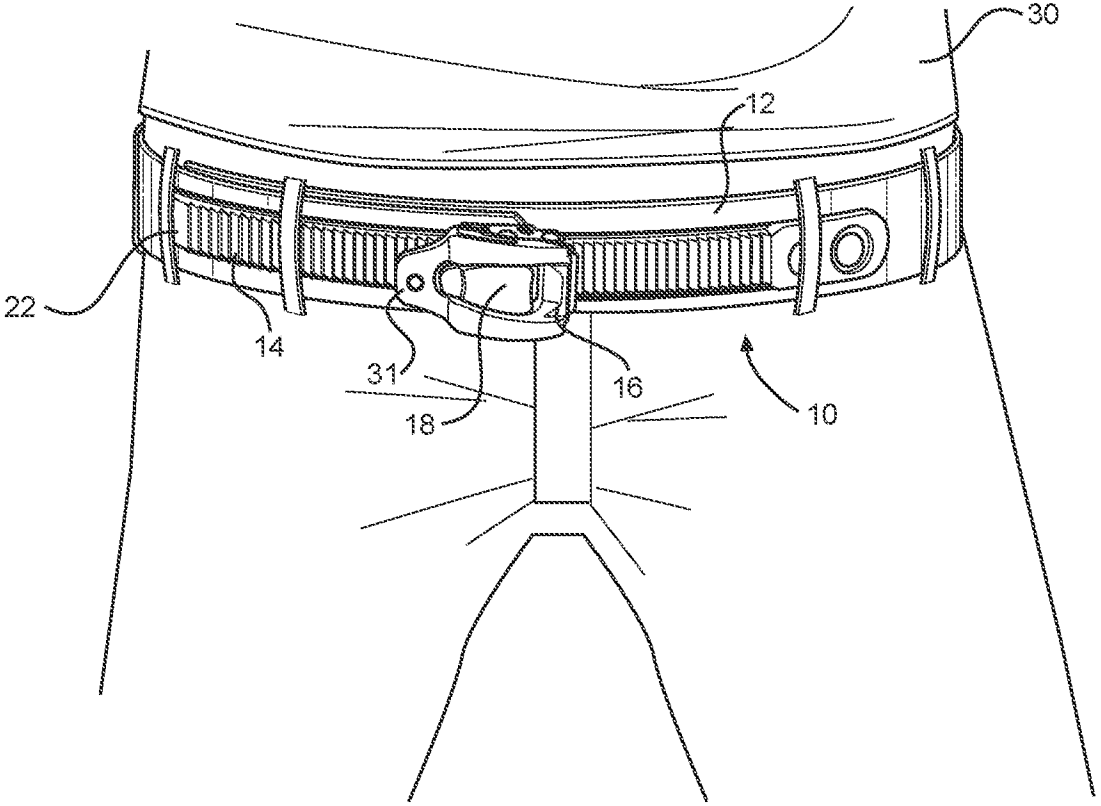
FIG. 5 depicts a perspective view of certain embodiments of the ratchet belt shown in use.

In certain embodiments as depicted in FIGS. 1 and 5, main strip 12 of ratchet belt 10 is configured to bend around user 30 to permit the first end of ladder strap 14 to insert through buckle 16 of the ratchet assembly. In one embodiment, elastic securement strap 32 is disposed around main strip 12 and ladder strap 14 and secured to itself. Elastic securement strap 32 secures tapered end 22 of ladder strap 14 against main strip 12. In one embodiment, elastic securement strap 32 comprises hook and loop fasteners, snap fasteners or other fasteners to secure the strap to itself.

Figure 4:
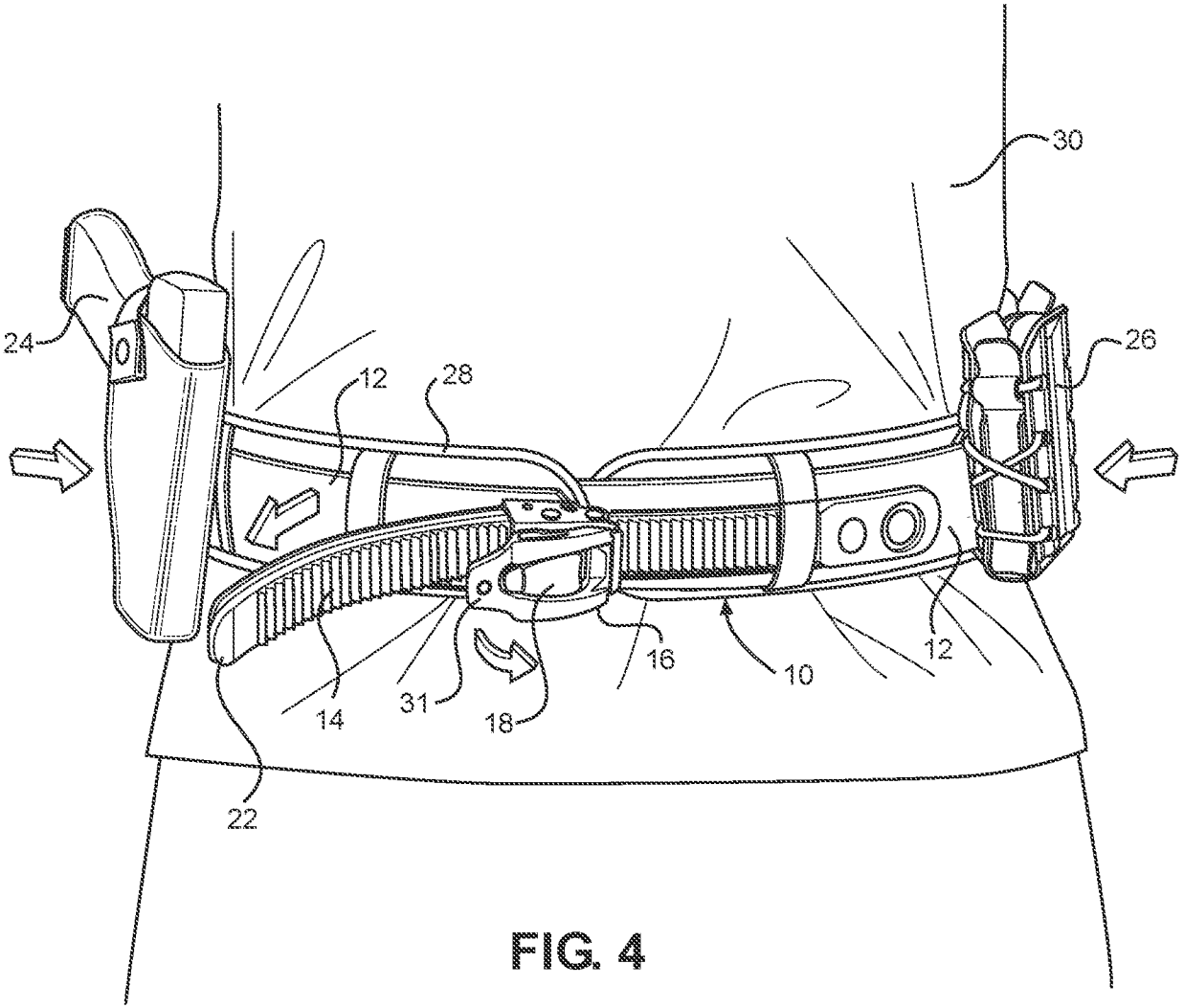
FIG. 4 depicts a perspective view of certain embodiments of the ratchet belt shown in use.

In certain embodiments as depicted in FIGS. 3-4, grip strap 28 is a flexible strap used in conjunction with main strip 12 and ladder strap 14 of ratchet belt 10. Grip strap 28 comprises a cushion member made from any materials such as rubber and/or neoprene, and is designed to directly wrap around user 30. In one embodiment, grip strap 28 comprises a 1000D Cordura laminate with a textured neoprene interior. In one embodiment, grip strap 28 comprises a plurality of loops. This allows main strip 12 of ratchet belt 10 to be fed through the plurality of loops in grip strap 28 so that grip strap 28, main strip 12 and ladder strap 14 are connected together as a single assembly as depicted in FIG. 3. Grip strap 28 enhances friction and prevents ratchet belt 10 from sliding when disposed on user 30. Further, grip strap 28 provides additional cushion that enhances comfort when ratchet belt 10 is secured to user 30.

In operation, ratchet belt 10 can be worn around any portion of the body of user 30. In one embodiment as depicted in FIG. 4, grip strap 28 and main strip 12 are disposed around user 30 to permit tapered end 22 of ladder strap 14 to be inserted through buckle 16 of the ratchet assembly. As illustrated by the arrows in FIG. 4, crank arm 31 is rotatably adjusted outward and released as many times as desired to feed ladder strap 14 through buckle 16. This allows main strip 12 to tighten and conform securely around the body of user 30. Each rotating adjustment and release of crank arm 31 allows crank arm 31 to engage with the next adjacent tooth in the plurality of teeth in ladder strap 14 as the strap is fed through buckle 16.

In a preferred embodiment, the ratchet assembly and plurality of teeth on ladder strap 14 permit ¼" incremental slidable adjustments of ladder strap 14 relative to buckle 16 each time crank arm 31 is rotatably adjusted and released. In a preferred embodiment, ladder strap 14 and main strip 12 provide up to 9" of slidable movement of ladder strap 14 relative to buckle 16.

Release lever 18 is rotatably adjusted as needed to adjust the position of ladder strap 14 relative to buckle 16. Release lever 18 is configured to adjust to a locked position in contact with one of the plurality of teeth of ladder strap 14 to prevent slidable movement of ladder strap 14 relative to buckle 16. Release lever 18 is configured to adjust to an unlocked position to permit slidable movement of ladder strap 14 relative to buckle 16. As such, release lever 18 in the unlocked position allows user 30 to easily loosen or tighten main strip 12 as desired.

In certain embodiments, ratchet belt 10 can be worn by user 30 in several configurations. In one embodiment, the use of ratchet belt 10 when grip strap 28, main strip 12 and ladder strap 14 are connected together as a single assembly is referred to as the battle belt configuration as depicted in FIGS. 3-4. The battle belt configuration is beneficial for use in law enforcement and military applications. In this configuration, ratchet belt 10 is secured around any portion of the body of user 30 such as on the waist region above all clothing as depicted in FIG. 4. Any number of firearms 24 and accessories 26 are attached to main strip 12 and/or grip strap 28 using holsters, clips, straps or other fastening components. It shall be appreciated that firearm 24 may be secured to the inside or outside of ratchet belt 10 when worn by user 30.

In an alternative embodiment, ratchet belt 10 can be worn by user 30 without the use of grip strap 28 as depicted in FIGS. 1 and 5. This configuration is beneficial for use by civilians. In this embodiment, ratchet belt 10 is secured around any portion of the body of user 30 such as on the waist region above all clothing or through the existing belt loops on pants as depicted in FIG. 5. Once ratchet belt 10 is properly secured to user 30, any number of firearms 24 and accessories 26 are attached to main strip 12 using holsters, clips, straps or other fastening components. It shall be appreciated that firearm 24 may be secured to the inside or outside of ratchet belt 10 when worn by user 30.

It shall be appreciated that the components of ratchet belt 10 described in several embodiments herein may comprise any alternative known materials in the field and be of any color, size and/or dimensions. It shall be appreciated that the components of ratchet belt 10 described herein may be manufactured and assembled using any known techniques in the field.

Persons of ordinary skill in the art may appreciate that numerous design configurations may be possible to enjoy the functional benefits of the inventive systems. Thus, given the wide variety of configurations and arrangements of embodiments of the present invention, the scope of the invention is reflected by the breadth of the claims below rather than narrowed by the embodiments described above.

What is claimed is:

1. A ratchet belt worn by a user with enhanced strength and load-bearing capacity, the ratchet belt configured to support a plurality of firearms, tactical gear and equipment thereon and permit the user to move into one of a plurality of body positions, the ratchet belt comprising:

a flexible strip comprising a first end and a second end, the first end of the flexible strip comprising a front edge extending in a first plane that is continuously connected to a pair of side corner edges, each side corner edge in the pair of side corner edges extending in a second plane that is oriented generally 45 degrees relative to the first plane, the flexible strip configured to support any number of the plurality of firearms, tactical gear and equipment thereon;

a ladder strap coupled to the flexible strip and comprising a plurality of teeth, the ladder strap comprising a first end aligned with the first end of the flexible strip and a second end coupled to an intermediate portion of the flexible strip; and a ratchet assembly coupled to the second end of the flexible strip and comprising a crank arm rotatably mounted to a buckle, the crank arm configured to engage with one of the plurality of teeth on the ladder strap, the ratchet assembly comprising a release lever rotatably mounted to the buckle, wherein the release lever is configured to adjust to a locked position in contact with one of the plurality of teeth of the ladder strap to prevent slidable movement of the ladder strap relative to the buckle, wherein the release lever is configured to adjust to an unlocked position to permit slidable movement of the ladder strap relative to the buckle;

wherein the flexible strip is configured to be disposed around the user to permit the first end of the ladder strap to insert through the buckle of the ratchet assembly, wherein the crank arm is rotatably adjusted to engage with one of the plurality of teeth in the ladder strap to enable the flexible strip to conform to the user.

2. The ratchet belt of claim 1, wherein the ratchet assembly and plurality of teeth on the ladder strap permit ¼" incremental slidable adjustments of the ladder strap relative to the buckle when the crank arm is rotatably adjusted.

3. The ratchet belt of claim 2, wherein the first end of the ladder strap comprises a tapered end.

4. The ratchet belt of claim 3, further comprising a grip strap configured to dispose around the user and permit attachment of the flexible strip and ladder strap thereto.

5. The ratchet belt of claim 4, further comprising an elastic securement strap disposed around the flexible strip and ladder strap to secure the first end of the ladder strap against the flexible strip.

6. The ratchet belt of claim 5, wherein a portion of the ratchet assembly extends beyond the second end of the flexible strip.

7. A method of securing any number of firearms, tactical gear and equipment to a user, the method comprising:

providing a ratchet belt, the ratchet belt comprising:

a flexible strip comprising a first end and a second end, the first end of the flexible strip comprising a front edge extending in a first plane that is continuously connected to a pair of side corner edges, each side corner edge in the pair of side corner edges extending in a second plane that is oriented generally 45 degrees relative to the first plane;

a ladder strap coupled to the flexible strip and comprising a plurality of teeth, the ladder strap comprising a first end aligned with the first end of the flexible strip and a second end coupled to an intermediate portion of the flexible strip; and a ratchet assembly coupled to the second end of the flexible strip and comprising a crank arm rotatably mounted to a buckle, the crank arm configured to engage with one of a plurality of teeth on the ladder strap, the ratchet assembly comprising a release lever rotatably mounted to the buckle, wherein the release lever is configured to adjust to a locked position in contact with one of the plurality of teeth of the ladder strap to prevent slidable movement of the ladder strap relative to the buckle, wherein the release lever is configured to adjust to an unlocked position to permit slidable movement of the ladder strap relative to the buckle;

disposing the flexible strip around the user;

inserting the first end of the ladder strap through the buckle of the ratchet assembly;

maneuvering the crank arm of the ratchet assembly to engage with one of the plurality of teeth in the ladder strap; and attaching any number of the firearms, tactical gear and equipment to the flexible strip.

8. The method of claim 7, further comprising maneuvering the release lever to permit slidable movement of the ladder strap relative to the buckle to a desired position.

* * * * *